US006585498B2

(12) United States Patent
Arbogast et al.

(10) Patent No.: US 6,585,498 B2
(45) Date of Patent: Jul. 1, 2003

(54) MOTOR-PUMP UNIT WITH PUMP SHAFT PINION ENMESHED WITH MOTOR ROTOR

(75) Inventors: Franz Arbogast, Heidenheim (DE); Gerd Hundt, Heidenheim (DE); Thomas Neubert, Hirschstein (DE)

(73) Assignee: Voith Turbo GmbH & Co KG, Heidenheim (DE)

( * ) Notice: Subject to any disclaimer, the term of this patent is extended or adjusted under 35 U.S.C. 154(b) by 0 days.

(21) Appl. No.: 09/980,286

(22) PCT Filed: Mar. 23, 2001

(86) PCT No.: PCT/EP01/03357

§ 371 (c)(1),
(2), (4) Date: May 8, 2002

(87) PCT Pub. No.: WO01/73295

PCT Pub. Date: Oct. 4, 2001

(65) Prior Publication Data

US 2002/0172605 A1 Nov. 21, 2002

(30) Foreign Application Priority Data

Mar. 29, 2000 (EP) ..... 100 15 139

(51) Int. Cl.[7] ..... F04B 17/00

(52) U.S. Cl. ..... 417/423.1; 417/353; 417/355; 417/410.3

(58) Field of Search ..... 417/353, 352, 417/355, 356, 366, 410.3, 410.9, 423.1

(56) References Cited

U.S. PATENT DOCUMENTS

| | | | | |
|---|---|---|---|---|
| 1,780,338 A | | 11/1930 | Canton | |
| 1,911,128 A | | 5/1933 | Apple | |
| 2,871,793 A | * | 2/1959 | Michie et al. | 103/118 |
| 3,672,793 A | | 6/1972 | Yowell | |
| 4,384,828 A | * | 5/1983 | Rembold et al. | 417/356 |
| 5,219,276 A | | 6/1993 | Metzner et al. | |
| 5,949,171 A | * | 9/1999 | Horski et al. | 310/216 |

FOREIGN PATENT DOCUMENTS

| | | |
|---|---|---|
| DE | 195 38 278 | 5/1996 |
| EP | 0 323 834 | 7/1989 |
| EP | 0 611 887 | 8/1993 |

* cited by examiner

*Primary Examiner*—Charles G. Freay
*Assistant Examiner*—John F. Belena
(74) *Attorney, Agent, or Firm*—Merchant & Gould, P.C.

(57) ABSTRACT

A motor-pump unit including an electric motor and a pump. The pump is concentrically surrounded by the rotor/stator of the motor. The rotor of the electric motor is U-shaped, viewed in an axial section. The cross-piece of the "U", in the region of the common axis, is provided with an interior toothing. The shaft of the pump includes a pinion that meshes with the interior toothing of the cross-piece of the "U".

5 Claims, 1 Drawing Sheet

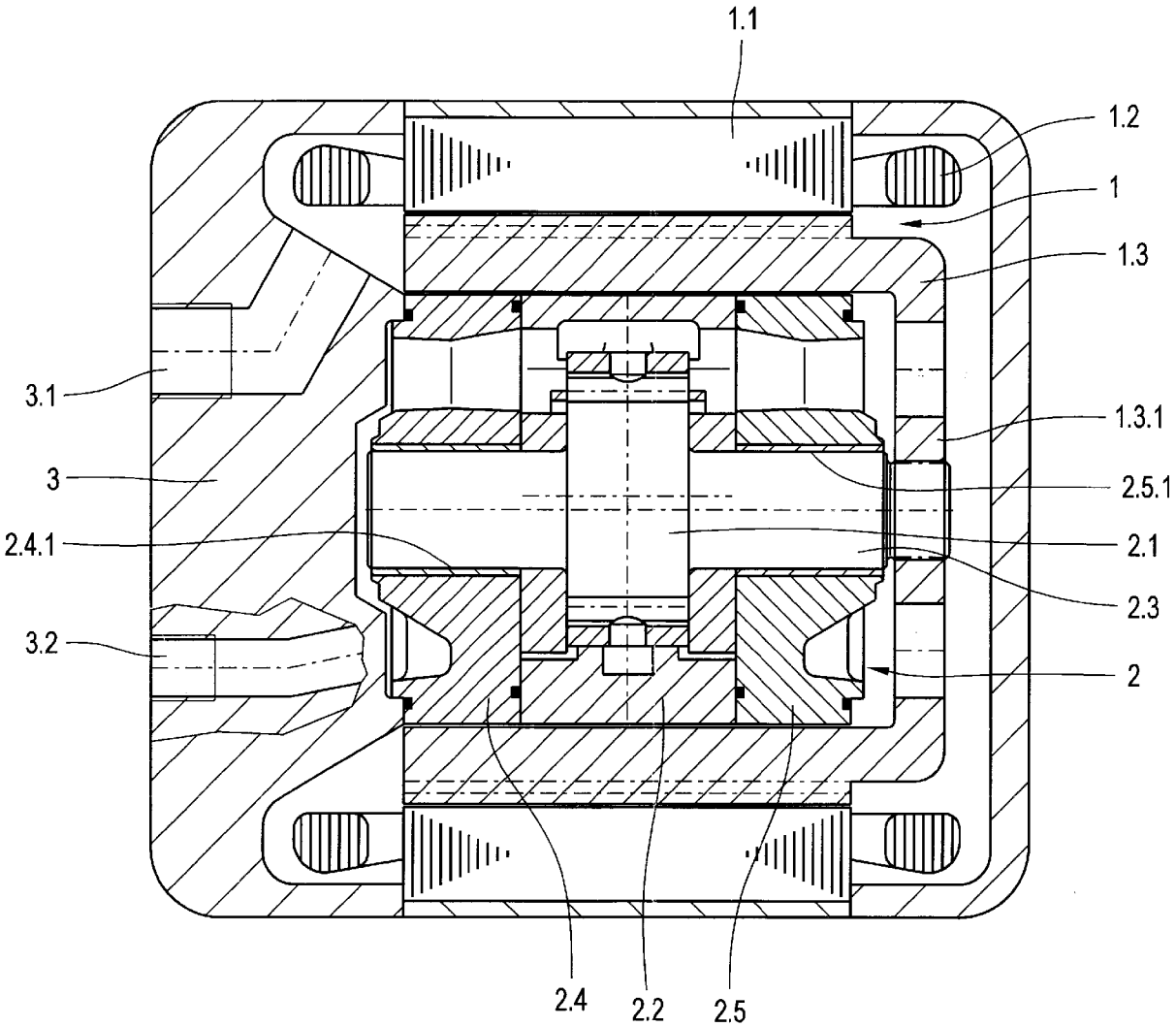
1.2
1
1.3
1.3.1
2.5.1
2.1
2.3
2
1.1
2.5
2.2
2.4
3.1
3
2.4.1
3.2

MOTOR-PUMP UNIT WITH PUMP SHAFT PINION ENMESHED WITH MOTOR ROTOR

The invention relates to a motor/pump unit, in which an electric motor and a pump are structurally unified with each other. In this, the rotor/stator of the motor surrounds the pump.

DE 195 38 278 A1 describes one such motor/pump unit. Here, the rotor of the electric motor is simultaneously the pump wheel of the pump.

EP 0 611 887 A1 describes a motor/pump unit. Here, although the rotor is a independent component, nevertheless it is attached to the cylinder block of a reciprocating pump in a rotationally-fixed manner.

Units of this design have the great advantage that they claim only a minimal amount of space. However, they are still capable of being improved.

The invention is based on the task of improving still further a motor/pump unit of the mentioned design, in particular with respect to the production cost and the space requirement.

This task is accomplished through a motor-pump unit including an electric motor and a pump that is concentrically surrounded by a rotor of the motor, the rotor of the electric motor being U-shaped, a cross-piece of the U-shaped rotor being provided with an interior toothing, and a shaft of the pump including a pinion that meshes with the interior toothing of the cross-piece.

Accordingly, the rotor of the electric motor, viewed in an axial section, is U-shaped. Here, the cross-piece of the "U" is provided, in the region of the axis of the unit, with an interior toothing, and the drive shaft of the pump with a corresponding pinion, so that the interior toothing and the pinion mesh with each other.

Different types of electric motors come into consideration, for example asynchronous motors, reluctance motors, or so-called short-circuit rotors.

Likewise, the most various types of pumps come into consideration. Especially advantageous is the application of the invention with inner gear pumps.

The pump forms in this case a completely independent, self-sufficient unit. It can be produced separately, tested separately, and be installed completely into the space enclosed by the stator of the electric motor.

Here, it is possible to support the rotor of the electric motor on the housing of the inner gear pump.

The invention is illustrated by means of the drawings. Represented in them are the following particulars:

The motor/pump unit comprises an electric motor 1 with a sheet-metal stator package 1.1, a winding 1.2, and a rotor 1.3.

It comprises further an inner gear pump 2. This displays a pinion 2.1, an eccentric hollow wheel 2.2 opposite this, as well as a pinion shaft 2.3. The pinion shaft 2.3 is seated in lateral discs 2.4, 2.5. In the present case, provision is made for slide bearings 2.4.1, 2.5.1.

The two elements motor and pump are enclosed by a common housing 3. Located in the housing is an intake 3.1 as well as an outlet 3.2 for the medium to be pumped.

According to the invention, the rotor 1.3 of the motor 1 is pot-shaped. In the present axial section it appears U-shaped. Here, the pinion shaft 2.3 is rotationally connected to the rotor 1.3 via a toothing. That is to say, located in the cross-piece 1.3.1 of the "U" is an interior toothing, while the pinion shaft displays a corresponding exterior toothing. The interior toothing and exterior toothing mesh with each other.

A different type of drive connection between the rotor 1.3 of the motor 1 and the pinion shaft 2.3 could also be produced. Thus, it is conceivable to design between these two elements not only a single, but rather two or several toothings with corresponding torque-transmitting elements, so that the rpm value of the rotor is translated upward or downward in the course of reaching the pinion shaft.

The rotor 1.3 is supported on the pump 2, more precisely on the hollow wheel 2.3 and the lateral discs 2.4, 2.5.

What is claimed is:

1. A motor-pump unit comprising:

an electric motor;

a pump;

the pump is concentrically surrounded by a rotor of the motor;

the rotor of the electric motor is U-shaped;

a cross-piece of the U-shaped rotor is provided with an interior toothing;

a shaft of the pump includes a pinion that meshes with the interior toothing of the cross-piece.

2. The motor-pump unit according to claim 1, wherein the rotor of the electric motor surrounds and is supported by a pump housing.

3. The motor-pump unit according to claim 1, wherein the pump is a hydropump.

4. The motor-pump unit according to claim 1, wherein the pump is configured such that at least a part of a throughput of an operating medium of the pump is used for cooling the motor.

5. The motor-pump unit according to claim 1, wherein the cross-piece and an adjacent front wall of the motor housing define an open space;

the shaft of the pump projects into the open space and carries an impeller; and the impeller is designed and arranged such that it conveys cooling medium from the motor into the pump.

* * * * *